US006242680B1

(12) United States Patent
Benton, Jr.

(10) Patent No.: US 6,242,680 B1
(45) Date of Patent: Jun. 5, 2001

(54) DRUM TUNING DEVICE

(76) Inventor: Charles E. Benton, Jr., 6880 Aspen Ct., Denver, NC (US) 28037

( * ) Notice: Subject to any disclaimer, the term of this patent is extended or adjusted under 35 U.S.C. 154(b) by 0 days.

(21) Appl. No.: 09/616,173

(22) Filed: Jul. 14, 2000

(51) Int. Cl.[7] ..... G10D 13/02
(52) U.S. Cl. ..... 84/411 R; 84/413; 84/411 A
(58) Field of Search ..... 84/411 R, 412, 84/413, 411 A

(56) References Cited

U.S. PATENT DOCUMENTS

| | | | | |
|---|---|---|---|---|
| Re. 33,685 | * | 9/1991 | Andre et al. | 84/413 |
| 2,172,578 | * | 9/1939 | Gladstone | 84/411 R |
| 4,244,265 | | 1/1981 | Tuttrup . | |
| 4,870,883 | | 10/1989 | Gauger . | |
| 5,392,681 | | 2/1995 | Hall . | |
| 5,442,988 | | 8/1995 | Mayo . | |
| 5,952,594 | * | 9/1999 | Chuang | 84/413 |

OTHER PUBLICATIONS

Leedy Drums and Accessories, Leedy Drum Co. cat. No. 70 Chicago 48, IL, 1965.*

* cited by examiner

*Primary Examiner*—Shih-Yung Hsieh
(74) *Attorney, Agent, or Firm*—Christopher C. Dremann

(57) ABSTRACT

A drum tuning device distributes the drawing force exerted on the drumhead by the tensioning lugs over an increased circumferential segment of the drum hoop. The tuning device includes a generally planar, relatively thin tuning plate having a circumferential dimension, a radial dimension and a thickness dimension. The circumferential dimension is substantially greater than the radial dimension and the thickness dimension. The tuning plate includes an arcuate inner surface conforming to the radial contour of the drum hoop and an outer surface substantially parallel to the inner surface. The tuning plate has an opening therethrough positioned medially between the inner surface and the outer surface. The tuning plate is positioned between the head portion of one of the tensioning lugs and the drum hoop. The tensioning lug is inserted through the opening of the tuning plate and engages the internally threaded floating fastener of a corresponding lug casing to exert the drawing force on the drum hoop and the drumhead. In an alternative embodiment, the drum tuning device includes a generally planar, relative thin tuning plate and further includes a relatively thin, wedge-shaped spacer having an opening therethrough. The spacer is positioned between the tuning plate and the drum hoop to provide a flat support surface for receiving the head of the tensioning lug. Preferably, the drum tuning device includes a plurality of tuning plates, or a plurality of tuning plates and spacers, corresponding to the plurality of tensioning lugs and lug casings provided on the drum.

20 Claims, 3 Drawing Sheets

DRUM TUNING DEVICE

CROSS REFERENCE TO RELATED APPLICATION (none)

FIELD OF THE INVENTION

The invention relates generally to a device for tuning a drum. More particularly, the invention is a device for tuning a drum that distributes the drawing force exerted on the drumhead by the tensioning lugs over an increased circumferential segment of the drum hoop.

BACKGROUND OF THE INVENTION

It has long been a common practice to provide a drum with a plurality of lug casings and a corresponding plurality of externally threaded tensioning lugs to secure a drumhead onto the shell of the drum. Typically, the plurality of lug casings are mounted on the exterior surface of the drum shell at equally spaced locations around the circumference of the drum. Each of the lug casings includes an internally threaded, floating fastener that is oriented generally parallel to the exterior surface of the drum shell. The tensioning lugs engage the floating fasteners of the lug casings to secure the drumhead onto the drum shell. The drum may have only a top drumhead, or may have both a top drumhead and a bottom drumhead. If provided, the bottom drumhead is secured onto the drum shell by a plurality of bottom tensioning lugs in the manner previously described. The bottom tensioning lugs may engage internally threaded, floating fasteners on the opposite side of the same lug casings, or the drum shell may be provided with a separate plurality of lug casings for engaging the bottom tensioning lugs.

The drumhead typically includes a substantially rigid outer ring made of metal or hard plastic that extends around the periphery of the drumhead. The tensioning lugs engage the outer ring to draw the drumhead downwardly onto the drum shell. In particular, the tensioning lugs typically include a head portion in the form of an integrally formed hex head nut and an externally threaded body portion extending outwardly from the head portion. A T-shaped torque wrench, commonly referred to as a "drum key," rotates the head portion of the tensioning lug so that the externally threaded body portion engages the internally threaded fastener of the lug casing, thereby drawing the drumhead onto the drum shell. As a result, the drawing force exerted by the tensioning lugs is concentrated on the drumhead at the discrete locations around the circumference of the drum shell that correspond to the predetermined locations of the lug casings. Alternatively, the drum may be further provided with an annular rim, commonly referred to as a drum hoop, made of a material that is at least as rigid as the material of the outer ring of the drumhead. The drum hoop has a plurality of openings therethrough for receiving the tensioning lugs. The drumhead and the drum hoop are positioned over the drum shell and the tensioning lugs are passed through the openings in the drum hoop to engage the fasteners of the lug casings. Although the drum hoop is generally stiffer than the outer ring provided on the drumhead, the drawing force exerted by the tensioning lugs nevertheless is still concentrated on the drumhead in the vicinity of the discrete locations around the circumference of the drum shell that correspond to the predetermined locations of the lug casings.

In addition to securing the drumhead onto the shell of the drum, the tensioning lugs are also used to tune the drum. The drummer positions the drumhead (and the drum hoop if utilized) over the drum shell and draws the drumhead (or the drum hoop and the drumhead) downwardly onto the drum shell until the tensioning lugs are finger tight. The drummer then taps the drumhead in the vicinity of each of the tensioning lugs and rotates the tensioning lug clockwise or counter-clockwise using the drum key to adjust the pitch of the drum. Rotating the drum key in the clockwise direction (i.e., tightening the tensioning lug) raises the pitch of the drum. Conversely, rotating the drum key in the counter-clockwise direction (i.e., loosening the tensioning lug) lowers the pitch of the drum. In about 1940, drums having eight or fewer lug casings and tensioning lugs per drumhead were first introduced. Drums having eight or fewer lug casings and tensioning lugs are less expensive to manufacture and require significantly less time to assemble and tune. However, because the lug casings (and thus the tensioning lugs) are spaced further apart around the circumference of the drum shell, the drum cannot be tuned as precisely as a drum having more than eight lug casings and tensioning lugs. With eight or fewer lug casings and tensioning lugs, the "dead" spots between adjacent tensioning lugs span a greater circumferential segment of the drumhead. As a result, there is a more distinct difference in pitch when the drum is struck at different locations around the circumference of the drumhead. In particular, there is a distinct difference in the pitch of the drum when struck centrally between adjacent tensioning lugs than when stuck in the immediate vicinity of a tensioning lug. The greater the number of tensioning lugs used to secure the drumhead to the drum shell, the more uniform the pitch when the drum is struck. However, as previously mentioned, the greater the number of tensioning lugs the more expensive it is to manufacture the drum and the more time is required to assemble and tune the drum.

There have been a number of prior attempts to provide a drum tuning device for tuning a drum having eight or fewer lug casings and tensioning lugs. U.S. Pat. No. 4,244,265 issued Jan. 13, 1981 to Tuttrup discloses a drum tuning apparatus including a plurality of lug casings and a corresponding plurality of cables stretched over the lug casings and attached to a slide mounted on a brace controlled by a screw jack. The slide ensures that the cables draw the drumhead and the drum hoop downwardly with equal force around the circumference of the drum shell to obtain consistent pitch. The Tuttrup apparatus, however, does not distribute the drawing force over an increased circumferential segment of the drum hoop. U.S. Pat. No. 5,442,988 issued Aug. 22, 1995 to Mayo discloses a keyless drum tuning device including a plurality of lug casings and a corresponding plurality of T-shaped tensioning lugs. The T-shaped tensioning lugs are seated into a drum hoop that extends around the periphery of the drumhead, thus applying tension over a broader circumferential area of the drumhead. The Mayo device, however, requires a special drum hoop, and thus, cannot be readily used with existing drums. U.S. Pat. No. 5,392,681 issued Feb. 28, 1995 to Hall discloses a drum tuning device including an expandable bladder positioned between the drumhead and the drum hoop. The drum hoop, the bladder and the drumhead are secured to the drum shell by a plurality of lug casings and tensioning lugs in the manner previously described. The pitch of the drum can be readily adjusted by inflating or releasing pressure from the bladder. The bladder provides a more uniform distribution of the drawing force around the circumference of the drumhead. However, the Hall drum tuning device requires extraneous external components, such as the bladder, a compressor, a pump and a source of pressurized fluid (air), and thus, unnecessarily increases the manufacturing cost and the complexity of assembling the drum.

Thus, it is apparent a need exists for a drum tuning device that distributes the drawing force exerted on the drumhead by the tensioning lugs over an increased circumferential segment of the drum hoop. It is further apparent a need exists for a drum tuning device that does not require a special drum hoop, and thus, can be readily used with existing drums. It is further apparent a need exists for a drum tuning device that does not require extraneous external components, and thus, does not unnecessarily increase the manufacturing cost and complexity of assembling the drum.

SUMMARY OF THE OBJECTS OF THE INVENTION

Accordingly, it is a principle object of the invention to provide a drum tuning device that distributes the drawing force exerted on the drumhead by the tensioning lugs over an increased circumferential segment of the drum hoop.

It is a further object of the invention to provide a drum tuning device that does not require a special drum hoop, and thus, can be readily used with existing drums.

It is a still further object of the invention to provide a drum tuning device that does not require extraneous external components, and thus, does not unnecessarily increase the manufacturing cost and complexity of the drum.

SUMMARY OF THE INVENTION

The invention is a drum tuning device for distributing the drawing force exerted on the drumhead by the tensioning lugs over an increased circumferential segment of the drum hoop. In the preferred embodiment, the drum tuning device includes a generally planar, relatively thin tuning plate having a circumferential dimension, a radial dimension and a thickness dimension. The circumferential dimension is substantially greater than the radial dimension and the thickness dimension. The radial dimension is at least as great as the thickness dimension, and preferably, is somewhat greater. Preferably, the circumferential dimension of the tuning plate is at least three times greater than the radial dimension and at least five times greater than the thickness dimension. The tuning plate includes an arcuate inner surface and has an opening therethrough for receiving one of the plurality of tensioning lugs. The tuning plate further includes an outer surface that is substantially parallel to the inner surface. The opening through the tuning plate is positioned medially between the inner surface and the outer surface so that the drawing force is distributed evenly over the radial dimension. The tuning plate further includes a central portion surrounding the opening and a pair of end portions extending circumferentially from the central portion. Preferably, the outer surface of the tuning plate adjacent the central portion is substantially parallel to the inner surface. Furthermore, the outer surface adjacent the end portions is curved radially inwardly to provide a smooth transition between the outer surface and the inner surface at the opposed ends of the tuning plate.

The tuning plate is preferably made of thin gauge stainless steel or is made of thin gauge steel and is plated with stainless steel. The tuning plate is positioned between a head portion of the tensioning lug and the drum hoop to uniformly distribute the drawing force over an increased circumferential segment of the drum hoop. More preferably, the tuning device consists of a plurality of circumferentially spaced tuning plates corresponding to the plurality of tensioning lugs and the plurality of lug casings. Thus, the combined drawing force of the plurality of tensioning lugs is evenly distributed over a plurality of increased circumferential segments of the drum hoop.

In another preferred embodiment, the tuning device includes a generally planar, relatively thin tuning plate, as previously described, and further includes a relatively thin, wedge-shaped spacer having an opening therethrough. The spacer is preferably made of a rigid, hard plastic material. The tuning plate is positioned between the head portion of the tensioning lug and the spacer and the spacer is positioned between the tuning plate and the drum hoop. The tensioning lug is then passed through the tuning plate, the spacer and the drum hoop to engage the fastener of the lug casing. The wedge-shape of the spacer ensures that the tuning plate provides a flat, horizontal surface for receiving the head portion of the tensioning lug. Thus, the tuning plate more evenly distributes the drawing force over an increased circumferential segment of the drum hoop. More preferably, the tuning device consists of a plurality of circumferentially spaced tuning plates and spacers corresponding to the plurality of tensioning lugs and lug casings. Thus, the combined drawing force of the plurality of tensioning lugs is evenly distributed over a plurality of increased circumferential segments of the drum hoop.

In operation, the invention provides a method of tuning a drum having a drumhead positioned on a drum shell and secured thereto by an annular drum hoop having a plurality of circumferentially spaced openings therethrough that receive a corresponding plurality of tensioning lugs. Each of the tensioning lugs engages a corresponding lug casing to draw the drum hoop and the drumhead downwardly onto the drum shell. The method includes the first step of providing a generally planar, relatively thin tuning plate having a circumferential dimension, a radial dimension and a thickness dimension. The circumferential dimension is substantially greater than the radial dimension and the thickness dimension. The radial dimension is at least as great as the thickness dimension, and preferably, is somewhat greater. The tuning plate includes an arcuate inner surface and has an opening therethrough for receiving one of the plurality of tensioning lugs. The method includes the second step of positioning the tuning plate between a head portion of the tensioning lug and the drum hoop to evenly distribute the drawing force over an increased circumferential segment of the drum hoop. Preferably, the method includes the further third step of providing a relatively thin, wedge-shaped spacer having an opening therethrough. The method preferably includes the further fourth step of positioning the spacer between the tuning plate and the drum hoop so that the tuning plate provides a flat, horizontal surface for receiving the head portion of the tensioning lug. Thus, the tuning plate more evenly distributes the drawing force over an increased circumferential segment of the drum hoop.

BRIEF DESCRIPTION OF THE DRAWINGS

The aforementioned and other objects of the invention will become more readily apparent when considered in conjunction with the following detailed description and the accompanying drawings in which.

DETAILED DESCRIPTION OF THE PREFERRED EMBODIMENTS

Figure 1:
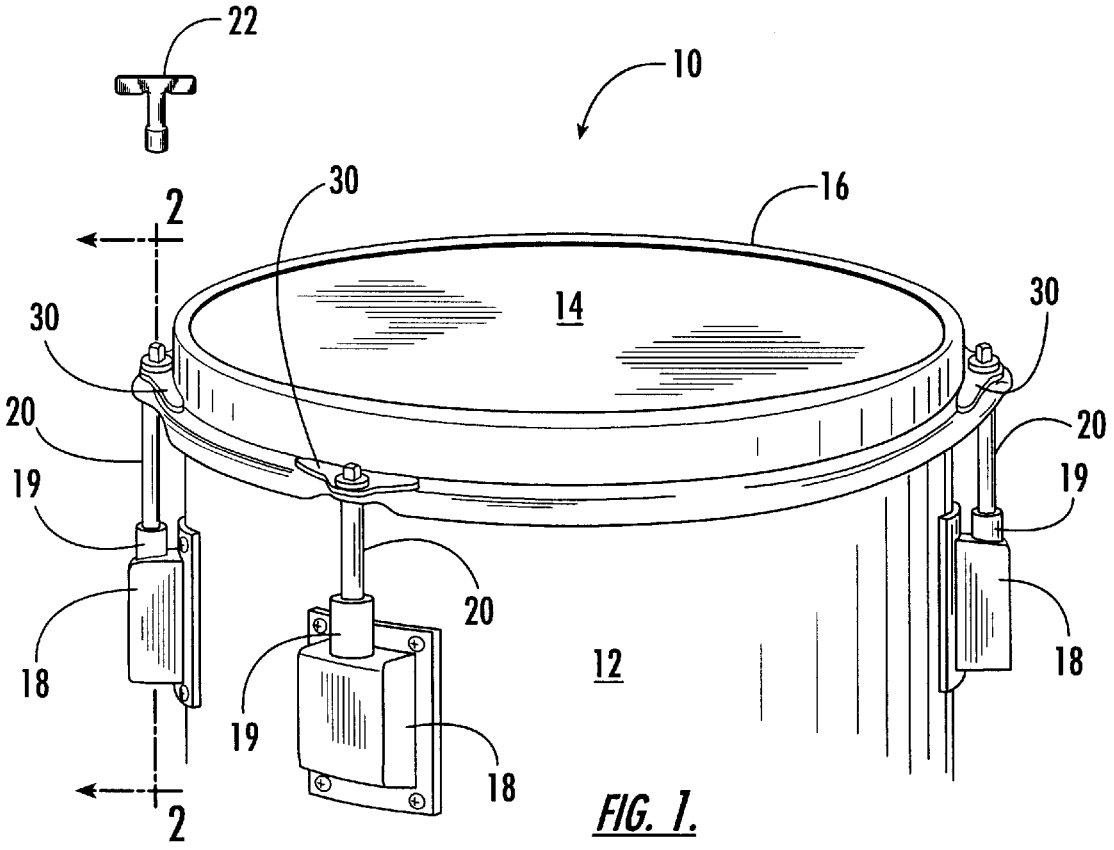
FIG. 1 is a perspective view illustrating a conventional drum including a plurality of lug casings and tensioning lugs and a corresponding plurality of drum tuning devices according to the invention for distributing the drawing force exerted by the tensioning lugs on the drumhead over an increased circumferential segment of the drum hoop.
Figure 2:
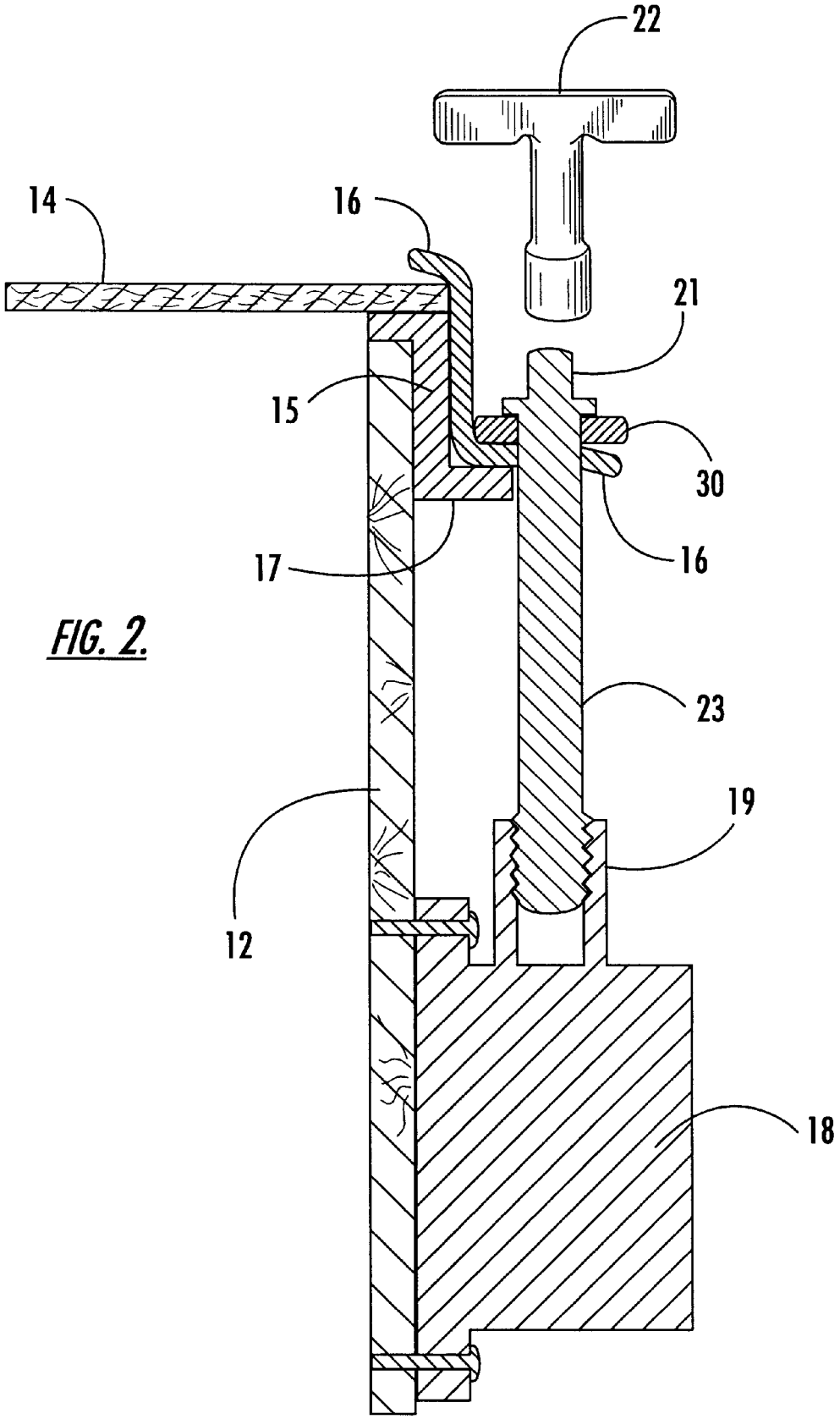
FIG. 2 is a vertical cross section of a typical lug casing, tensioning lug and drum tuning device of the drum of FIG. 1 taken along line 2—2 of FIG. 1.

Referring now to the accompanying figures wherein like reference numerals represent like parts in the various views, FIG. 1 illustrates a conventional drum 10. The drum 10 comprises a drum shell 12, a drumhead 14 and an annular rim or drum hoop 16. A plurality of lug casings 18 are positioned around the circumference of the drum shell 12. Preferably, the lug casings 18 are positioned on the exterior surface of the drum shell 12 at equally spaced locations around the circumference of the drum 10. Each of the lug casings 18 comprises an internally threaded, floating fastener 19 for receiving one of a corresponding plurality of externally threaded tensioning lugs 20. As best shown in FIG. 2, the tensioning lugs 20 each comprise a head portion 21 and a body portion 23 extending downwardly from the head portion 21. The head portion 21 is preferably formed in the shape of a hex head nut for engaging a conventional drum key 22, as will be described. The lower end of the body portion 23 opposite the head portion 21 is externally threaded to engage the corresponding internally threaded fastener 19. The drumhead 14 is positioned over the drum shell 12 and the drum hoop 16 is positioned over the drumhead 14. The drum hoop 16 has a plurality of openings therethrough that are aligned with the fasteners 19 of the lug casings 18. The tensioning lugs 20 are inserted through the openings in the drum hoop 16 and engage the fasteners 19 of the lug casings to secure the drum hoop 16 and the drumhead 14 onto the drum shell 12.

The tensioning lugs 20 are also utilized to tune the drum 10 using the drum key 22 in a known manner. In particular, the drum key 22 is positioned over the head portion 21 of the tensioning lug 20 and the drum key 22 is rotated in a clockwise or counter-clockwise direction. Specifically, the drum key 22 is rotated clockwise (i.e., the tensioning lug 20 is tightened) to raise the pitch of the drum 10. Conversely, the drum key 22 is rotated counter-clockwise (i.e., the tensioning lug 20 is loosened) to lower the pitch of the drum 10. The drumhead 14 preferably comprises a relatively rigid outer ring 15 (FIGS. 2, 5) extending around the periphery of the drumhead 14. The outer ring 15 provides a ledge 17 having increased bending stiffness for distributing the drawing force exerted by the tensioning lugs 20 on the drumhead 14. Regardless, the drawing force exerted on the drum hoop 16 and the drumhead 14 by the tensioning lugs 20 remains concentrated at the discrete positions around the outer ring 15 that correspond to the locations of the lug casings 18 on the drum shell 12. As will be described, the drum tuning device of the present invention comprises a tuning plate 30 that distributes the drawing force exerted on the outer ring 15 of the drumhead 14 by the tensioning lugs 20 over an increased circumferential segment of the drum hoop 16.

Figure 4:
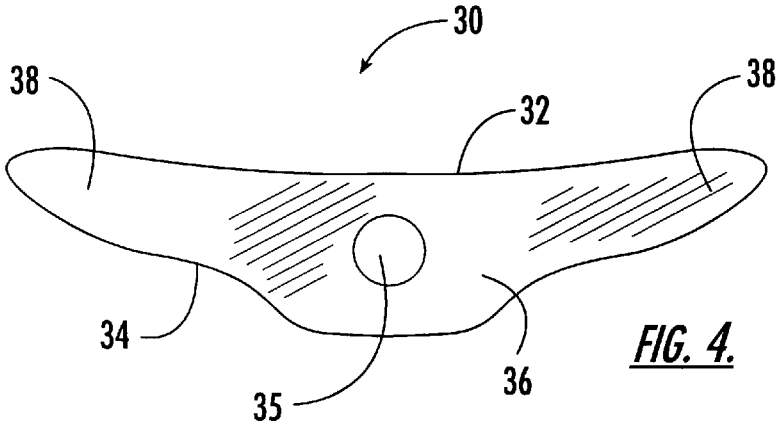
FIG. 4 is a top plan view of the tuning plate of one of the plurality of drum tuning devices of FIG. 1.
Figure 3:
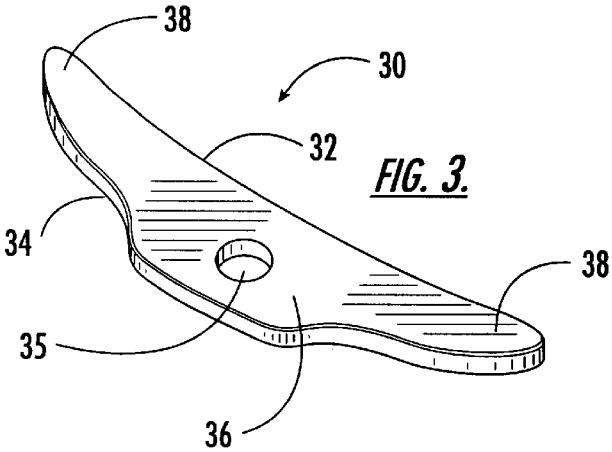
FIG. 3 is a perspective view of the tuning plate of one of the plurality of drum tuning devices of FIG. 1.

A preferred embodiment of the tuning plate 30 of the drum tuning device is shown in FIGS. 3 and 4. The tuning plate 30 comprises a generally planar, relatively thin body made of a hard, rigid material. Preferably, the tuning plate 30 is made of thin gauge stainless steel or is made of thin gauge steel that is covered by a thin plating of stainless steel. The tuning plate 30 has a circumferential dimension, a radial dimension and a thickness dimension. The circumferential dimension is oriented along the periphery of the drum hoop 16. The radial dimension is oriented along a radial of the drumhead 14 and the thickness dimension is oriented generally perpendicular to the circumferential dimension and the radial dimension. The circumferential dimension of the tuning plate 30 is substantially greater than the radial dimension and the thickness dimension. Preferably, the circumferential dimension of the tuning plate 30 is at least three times greater than the radial dimension and is at least five times greater than the thickness dimension. As will be apparent to one of ordinary skill, the bending stiffness of the tuning plate 30 about the radial axis is a function of the material from which it is made and is inversely proportional to the ratio of the circumferential dimension to the thickness dimension.

The tuning plate 30 further comprises an arcuate inner surface 32 that extends in the direction of the circumferential dimension. The arcuate inner surface 32 conforms to the radial periphery of the drum hoop 16 adjacent the head portion 21 of the tensioning lugs 20. The tuning plate 30 further comprises an outer surface 34 opposite and substantially parallel to the inner surface 32. An opening 35 is formed through the tuning plate 30 for receiving the body portion 23 of one of the tensioning lugs 20. The opening 35 is preferably positioned medially between the inner surface 32 and the outer surface 34. The tuning plate 30 further comprises a central portion 36 surrounding the opening 35 and a pair of opposed end portions 38 extending outwardly from the central portion 36 in the direction of the circumferential dimension. Preferably, the outer surface 34 adjacent the central portion 36 is substantially parallel to the inner surface 32 and the outer surface 34 adjacent the end portions 38 is curved radially inwardly to provide a smooth transition between the outer surface 34 and the inner surface 32 at the opposed ends of the tuning plate 30.

In operation, the tuning plate 32 is positioned between the head portion 21 of the tensioning lug 20 and the upper surface of the radially extending flange of the drum hoop 16. As a result, the tuning plate 30 evenly distributes the drawing force exerted on the drumhead 14 by the tensioning lug 20 over an increased circumferential segment of the drum hoop 16. As illustrated in FIG. 1, the drum tuning device of the invention preferably comprises a plurality of tuning plates 30 corresponding to the plurality of tensioning lugs 20 and the plurality of lug casings 18 provided on the drum shell 12. The plurality of tuning plates 30 are circumferentially spaced about the drum hoop 16 so that the combined drawing force of the plurality of tensioning lugs 20 is evenly distributed over a corresponding plurality of increased circumferential segments of the drum hoop 16. Accordingly, the drummer is able to tune the drum 10 as well as if the drum shell 12 were provided with two or three times as many lug casings 18. The drum 10, however, is no more expensive to manufacture. Furthermore, it is no more complex or time consuming to assemble and tune the drum 10 than a drum that does not utilize the plurality of tuning plates 30.

Figure 5:
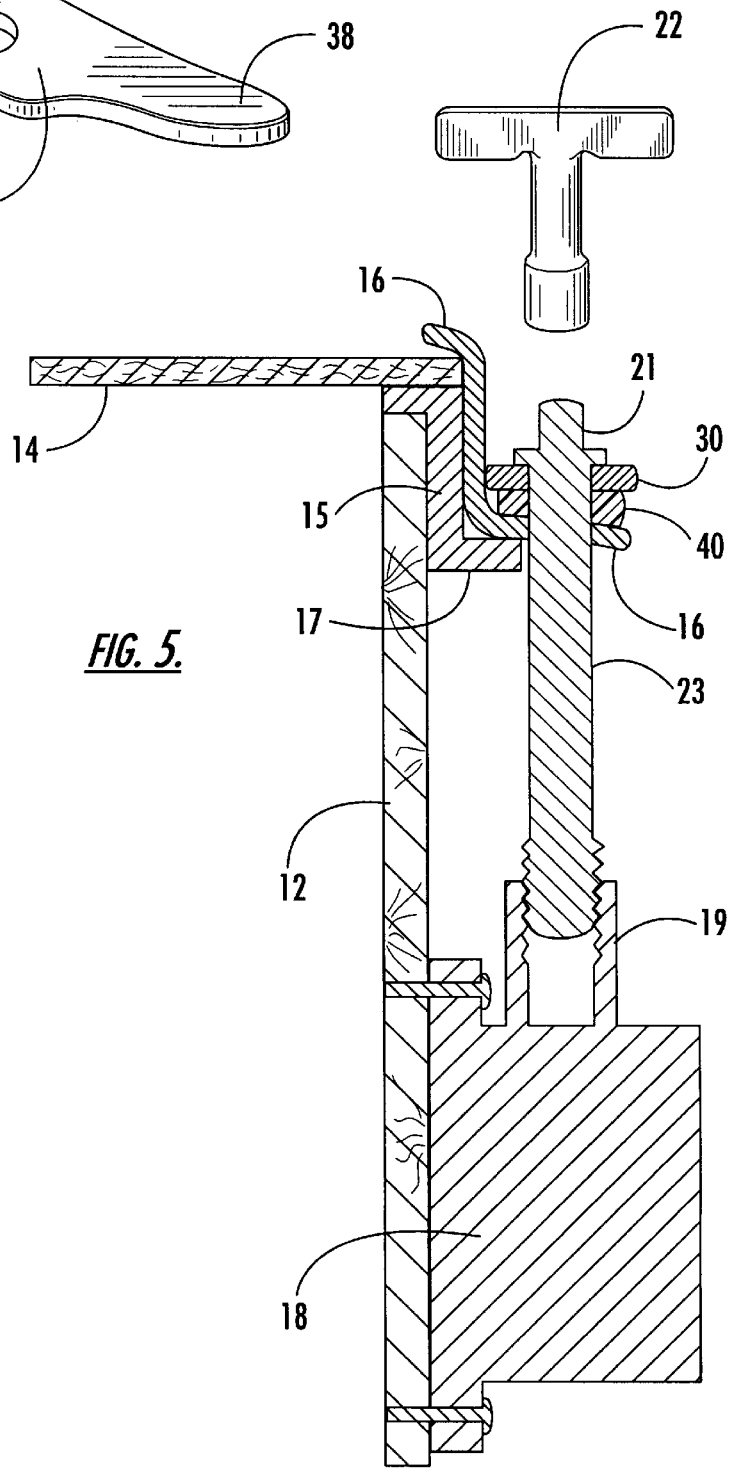
FIG. 5 is a vertical cross section of a typical lug casing and tensioning lug along with an alternative embodiment of a drum tuning device according to the invention.

FIG. 5 illustrates an alternative embodiment of a drum tuning device according to the invention. In the alternative embodiment, the drum tuning device further comprises a relatively thin, wedge-shaped spacer 40. The spacer 40 is made of a substantially rigid material, such as hard plastic or metal. Preferably, the spacer 40 is made of a thermoplastic, neoprene material having a durometer greater than about 60. The spacer 40 has an opening therethrough for receiving the body portion 23 of one of the plurality of tensioning lugs 20. The spacer 40 is positioned between the tuning plate 30 and the upper surface of the radially extending flange of the drum hoop 16. Typically, the radially extending flange of the drum hoop 16 is angled downwardly relative to horizontal a slight amount. In addition, the radially extending flange of the drum hoop 16 typically has a fillet radius that extends around the periphery of the drum hoop. The angle of the radially extending flange and the fillet radius of the drum hoop 16 can cause the tuning plate 30 to be skewed relative to horizontal when positioned between the head portion 21 of the tensioning lug 20 and the radially extending flange of the drum hoop 16. As a result, the effectiveness of the tuning plate 30 to evenly distribute the drawing force over an increased circumferential segment of the drum hoop 16 is diminished. The wedge-shaped spacer 40 ensures that the tuning plate 30 remains generally parallel to the underside of the head portion 21 of the tensioning lug 20 so that the drawing force is more effectively distributed over an increased circumferential segment of the drum hoop 16. As previously described, the drum tuning device preferably comprises a plurality of tuning plates 30 and spacers 40 corresponding to the plurality of tensioning lugs 20 and the plurality of lug casings 18 provided on the drum shell 12 circumferentially spaced about the drum hoop 16 so that the combined drawing force of the plurality of tensioning lugs 20 is evenly distributed over a corresponding plurality of increased circumferential segments of the drum hoop 16.

As should now be apparent, the invention provides a drum tuning device that distributes the drawing force exerted on the drumhead by the tensioning lugs over an increased circumferential segment of the drum hoop. In addition, the invention provides a drum tuning device that does not require a special drum hoop, and thus, can be readily used with existing drums. The invention also provides a drum tuning device that does not require extraneous external components, and thus, does not unnecessarily increase the manufacturing cost and complexity of the drum. In an alternative embodiment, the invention further provides a drum tuning device including a wedge-shaped spacer that ensures the drawing force is effectively distributed over an increased circumferential segment of the drum hoop even if the radially extending flange of the drum hoop is angled relative to horizontal or a fillet radius extends around the periphery of the drum hoop.

That which is claimed is:

1. A device for tuning a drumhead positioned on a drum shell and secured thereto by an annular drum hoop having a plurality of circumferentially spaced openings therethrough for receiving a corresponding plurality of tensioning lugs, each of the tensioning lugs engaging a corresponding lug casing to exert a drawing force on the drum hoop and the drumhead, the drum tuning device comprising:

a generally planar, relatively thin tuning plate having a circumferential dimension, a radial dimension and a thickness dimension, the circumferential dimension substantially greater than the radial dimension and the thickness dimension, the tuning plate comprising an arcuate inner surface and having an opening therethrough for receiving one of the plurality of tensioning lugs;

wherein the tuning plate is positioned between a head portion of the tensioning lug and the drum hoop to evenly distribute the drawing force over an increased circumferential segment of the drum hoop.

2. A drum tuning device according to claim 1 wherein the circumferential dimension of the tuning plate is at least three times greater than the radial dimension.

3. A drum tuning device according to claim 1 wherein the circumferential dimension of the tuning plate is at least five times greater than the thickness dimension.

4. A drum tuning device according to claim 1 wherein the tuning plate further comprises an outer surface opposite and substantially parallel to the inner surface and wherein the opening is positioned medially between the inner surface and the outer surface.

5. A drum tuning device according to claim 4 wherein the tuning plate comprises a central portion surrounding the opening and a pair of end portions extending outwardly from the central portion in the direction of the circumferential dimension.

6. A drum tuning device according to claim 5 wherein the outer surface adjacent the central portion is substantially parallel to the inner surface and the outer surface adjacent the end portions is curved radially inwardly to provide a smooth transition between the outer surface and the inner surface at the opposed ends of the tuning plate.

7. A drum tuning device according to claim 1 wherein the tuning plate is made of thin gauge stainless steel.

8. A drum tuning device according to claim 1 wherein the tuning plate is made of thin gauge steel and is plated with stainless steel.

9. A drum tuning device according to claim 1 comprising a plurality of tuning plates circumferentially spaced about the drum hoop corresponding to the plurality of tensioning lugs and the plurality of lug casings so that the combined drawing force of the plurality of tensioning lugs is evenly distributed over a plurality of increased circumferential segments of the drum hoop.

10. A device for tuning a drumhead positioned on a drum shell and secured thereto by an annular drum hoop having a plurality of circumferentially spaced openings therethrough for receiving a corresponding plurality of tensioning lugs, each of the tensioning lugs engaging a corresponding lug casing to exert a drawing force on the drum hoop and the drumhead, the drum tuning device comprising:

a generally planar, relatively thin tuning plate having a circumferential dimension, a radial dimension and a thickness dimension, the circumferential dimension substantially greater than the radial dimension and the thickness dimension, the tuning plate comprising an arcuate inner surface and having an opening therethrough for receiving one of the plurality of tensioning lugs; and a relatively thin, wedge-shaped spacer having an opening therethrough;

wherein the tuning plate is positioned between a head portion of the tensioning lug and the spacer and the spacer is positioned between the tuning plate and the drum hoop to evenly distribute the drawing force over an increased circumferential segment of the drum hoop.

11. A drum tuning device according to claim 10 wherein the circumferential dimension of the tuning plate is at least three times greater than the radial dimension.

12. A drum tuning device according to claim 10 wherein the circumferential dimension of the tuning plate is at least five times greater than the thickness dimension.

13. A drum tuning device according to claim 10 wherein the tuning plate further comprises an outer surface opposite and substantially parallel to the inner surface and wherein the opening is positioned medially between the inner surface and the outer surface.

14. A drum tuning device according to claim 13 wherein the tuning plate comprises a central portion surrounding the opening and a pair of end portions extending outwardly from the central portion in the direction of the circumferential dimension.

15. A drum tuning device according to claim 14 wherein the outer surface adjacent the central portion is substantially parallel to the inner surface and the outer surface adjacent the end portions is curved radially inwardly to provide a smooth transition between the outer surface and the inner surface at the opposed ends of the tuning plate.

16. A drum tuning device according to claim 10 wherein the tuning plate is made of thin gauge steel and is plated with stainless steel.

17. A drum tuning device according to claim 10 wherein the spacer is made of a rigid, hard plastic material.

18. A drum tuning device according to claim 10 comprising a plurality of tuning plates and spacers circumferentially spaced about the drum hoop corresponding to the plurality of tensioning lugs and the plurality of lug casings so that the combined drawing force of the plurality of tensioning lugs is evenly distributed over a plurality of increased circumferential segments of the drum hoop.

19. A method of tuning a drum having a drumhead positioned on a drum shell and secured thereto by an annular drum hoop having a plurality of circumferentially spaced openings therethrough for receiving a corresponding plurality of tensioning lugs, each of the tensioning lugs engaging a corresponding lug casing to exert a drawing force on the drum hoop and the drumhead, the method comprising the steps of:

providing a generally planar, relatively thin tuning plate having a circumferential dimension, a radial dimension and a thickness dimension, the circumferential dimension substantially greater than the radial dimension and the thickness dimension, the tuning plate comprising an arcuate inner surface and having an opening therethrough for receiving one of the plurality of tensioning lugs; and positioning the tuning plate between a head portion of the tensioning lug and the drum hoop to evenly distribute the drawing force over an increased circumferential segment of the drum hoop.

20. A method according to claim 19 comprising the further steps of:

providing a relatively thin, wedge-shaped spacer having an opening therethrough; and positioning the spacer between the tuning plate and the drum hoop to evenly distribute the drawing force over an increased circumferential segment of the drum.

* * * * *